US005165138A

United States Patent [19]

Garabedian

[11] Patent Number: 5,165,138

[45] Date of Patent: Nov. 24, 1992

[54] CLEANING DEVICE

[76] Inventor: Charles Garabedian, 32 Bridge St., Salem, N.H. 03079

[21] Appl. No.: 747,125

[22] Filed: Aug. 19, 1991

[51] Int. Cl.[5] ..... A47L 13/20

[52] U.S. Cl. ..... 15/247; 15/228; 15/231; 15/209.1

[58] Field of Search ..... 15/104 A, 209 R, 210 R, 15/228, 231-233, 247; 51/62, 135 R, 136, 142, 174, 180, 382, 387, 391, 392

[56] References Cited

U.S. PATENT DOCUMENTS

| | | | |
|---|---|---|---|
| 752,475 | 2/1904 | Smith | 51/392 |
| 2,638,618 | 5/1953 | Legge | 15/247 |
| 2,810,149 | 10/1957 | Guelker | 15/231 |
| 3,430,496 | 3/1969 | Swanberg et al. | 15/231 |
| 4,640,539 | 2/1987 | LaPorte | 15/104 A |

FOREIGN PATENT DOCUMENTS

| | | | |
|---|---|---|---|
| 2848816 | 6/1979 | Fed. Rep. of Germany | 15/247 |
| 646994 | 11/1928 | France | 15/232 |
| 946896 | 12/1948 | France | 15/247 |
| 2328437 | 5/1977 | France | 15/232 |

*Primary Examiner*—Harvey C. Hornsby
*Assistant Examiner*—Mark Spisich
*Attorney, Agent, or Firm*—Edward A. Gordon

[57] ABSTRACT

A cleaning device adapted to be attached to an existing cleaning apparatus having a base member and an upwardly extending handle member and in another embodiment includes a base member, the cleaning device including an elongated flexible cleaning member having remote opposing end members and opposing side members and a substantially planer inner surface and a cleaning material mounted on the outer surface; a flexible mounting device attached to the opposite remote ends of the cleaning member; and a clamp device for mounting on the upper portion of the handle member for engaging and securing the mounting device in selected positions. The flexible mounting device is releasably attachable to the clamp device to thereby mount and maintain the inner surface of the cleaning member about the bottom surface of the base member. The clamp device is releasable with respect to the mounting device to permit the section of the cleaning member about the base portion to be moved to thereby remove the section of the cleaning member which is dirty from cleaning from the bottom surface of the base member and introduce a clean section of the cleaning member about the bottom surface of the base member.

16 Claims, 4 Drawing Sheets

CLEANING DEVICE

BACKGROUND OF THE INVENTION

1. Field of the Invention

The present invention relates to cleaning devices and more particularly to a new and improved cleaning device which is constructed and arranged so as to be readily adjustable so that the operator may obtain clean sections by quickly adjusting the elongated strip cleaning material which is also constructed to be attachable to existing cleaning devices to provide an elongated adjustable strip cleaning material.

2. Description of Prior Art

It is common practice, for example, to use a mop to clean floors and the like in which the mop is used in connection with one or more receptacles wherein, for example, one receptacle contains a soap and water solution and a second receptacle contains a clear water solution for rinsing the mop. The mop is dipped into the soap and water solution and applied to the floor to loosen and remove the dirt. When the mop is again inserted into the receptacle containing the soap and water solution, the mop carries dirt into the solution and in a short while the solution becomes dirty so that it is necessary to throw it away and to replace it with clean cleaning fluid. Even when the cleaning solution is first used, the small amount of dirt released by the first mop insertion means that the floor is being washed with a suspension of dirt and the floor is dulled by the thin layer of dirt which remains when the floor dries. In the same way, if the mop is inserted in the rinsing solution, dirt is carried into the rinsing solution so that it must be disposed of at fairly frequent intervals. Even when a separate mop is used with the rinsing solution, the mop picks up dirt from the floor and releases it into the solution so that the rinsing solution must be replaced frequently. Not only is it time consuming to replace the cleaning fluid, as well as the rinsing fluid, but such frequent replacement is expensive, since the detergent or soap is thrown away with the cleaning fluid and, if hot water is used in both the cleaning fluid and the rinsing fluid, the use of large amounts of hot water in an institution, such as a hospital, adds considerably to the cost of maintaining the institution.

The conventional floor sweeping tool which has been widely used for a long period of time is, of course, the dust mop. However, dust mops do not provide the sanitary cleaning which is needed at institutions such as hospitals where thorough and complete cleaning is a necessity to prevent the spread of germs.

Another type of floor cleaning tool which has been used in place of dust mops has employed a web of material, such as cloth or paper, with the web unwinding from a supply roll across the floor and then onto a takeup or windup roll. While floor cleaning tools of this type have proved more satisfactory than simple dust mops, they have suffered from the disadvantage that the used or dirty web is rewound onto a takeup roll and is hence transported from area to area within the hospital or other installation until the entire roll of material has been used up and dirtied. In such an arrangement, there is always the problem that the germs which are carried by the dirty web, as wound upon the takeup roll, are transported from one area in a hospital, such as a contagious ward, to another area which might be intended to be a noncontagious ward. Still further, it has been found that dual roll cleaning tools of this type are generally somewhat expensive to manufacture and are somewhat more difficult for the operator to use, since the operator must push the weight of both the clean roll and the dirty roll and any foreign material which has been wound onto the dirty roll.

The foregoing examples of the prior art as well as the following U.S. Patents are believed to exemplify the present state of the art with respect to such cleaning devices.

| | | |
|---|---|---|
| 2,690,582 | 2,891,270 | 3,376,595 |
| 2,828,501 | 3,199,136 | 3,641,612 |

While such prior art devices provide improvement in the areas intended, there still exists a need for a cleaning device which overcomes the disadvantages of the prior art while providing utility features which provide new and useful advantages and improvements not heretofore disclosed.

Accordingly, a principle desirable object of the present invention is to provide a new and improved cleaning device which overcomes the disadvantages of the prior art devices.

Another desirable object of the present invention is to provide a cleaning device having an elongated cleaning strip member which is adjustable so that a dirty section is replaced by a clean section.

Another desirable object of the present invention is to provide an elongated cleaning strip device which is adapted to be secured to an existing mop, broom, etc. as an attachment thereto and which can be readily adjusted by the user to provide fresh cleaning surface sections.

Another desirable object of the present invention is to provide elongated cleaning strips which have various outer cleaning surfaces for selected cleaning purposes.

Another desirable object of the present invention is to provide a cleaning device which has little or no limitation on the configuration or size of an existing mop head.

Another desirable object of the present invention is to provide a cleaning device which can be easily used for cleaning generally flat surfaces such as floors, walls, ceilings and the like.

Another desirable object of the present invention is to provide a cleaning device in accordance with the foregoing desirable objects that is readily portable and which may be economically manufactured and be of durable character.

These and other desirable objects of the present invention will in part appear hereinafter and will in part become apparent after consideration of the specification with reference to the drawings and the claims.

SUMMARY OF THE INVENTION

The present invention provides a new and improved cleaning device adapted to clean generally flat surfaces. In one important feature of the invention, the cleaning device comprises an elongated base member having a substantially planer top surface and a handle member extending upwardly from the center of the top surface of the base member and having a forward portion and a rearward portion. In a preferred embodiment, a pair of framework members are secured to the opposing side ends of the base member and extend beyond the forward and rearward side ends to maintain an elongated flexible cleaning member adjacent the bottom surface of the base member. The elongated flexible cleaning member is adapted to have a substantially planer inner surface and a cleaning material mounted on the outer surface of the cleaning member. The cleaning material mounted on the outer surface of the cleaning member can be varied to accomplish the selected cleaning purpose such as, for example, dusting, washing, scrubbing, polishing, etc. The cleaning member includes remote opposing end members to which a pair of flexible cable members are attached. A clamp member is mounted on the upper portion of the handle member and contains a pair of rotating members which are adapted to releasably receive the cable members. In this manner, the cable members are mounted on the rotating disk members of the clamp member and the inner surface of the cleaning member about the bottom surface of the base member so that one end of the cleaning member is adjacent the rearward portion of the handle member and the clamp member and the other end of the cleaning member adjacent the forward portion of the top surface of the base member whereby the clamp member provides for releasable movement of the cleaning member about the lower surface of the base member to thereby remove the portion of the cleaning member, which is dirty from cleaning, about the lower surface of the base member and thereby introduce a clean section of the cleaning member about the bottom portion of the base member.

Another important feature of the present invention is the embodiment of the cleaning device which includes the clamp member, flexible cable members and the elongated flexible cleaning member which together as a cleaning device is adapted to be mounted on existing cleaning devices such as, for example, brooms, sponge mops, and other such devices which use a flat or curved base surface for cleaning. In this manner when a portion of the cleaning member which covers the base surface becomes dirty the operator may move the cleaning member to replace the dirty section with a clean section for each cleaning purpose.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein:

FIG. 14*b* is a perspective view of the clamp member of the clamp member of FIG. 14*a.

DETAILED DESCRIPTION OF PREFERRED EMBODIMENT(S)

Figure 1:
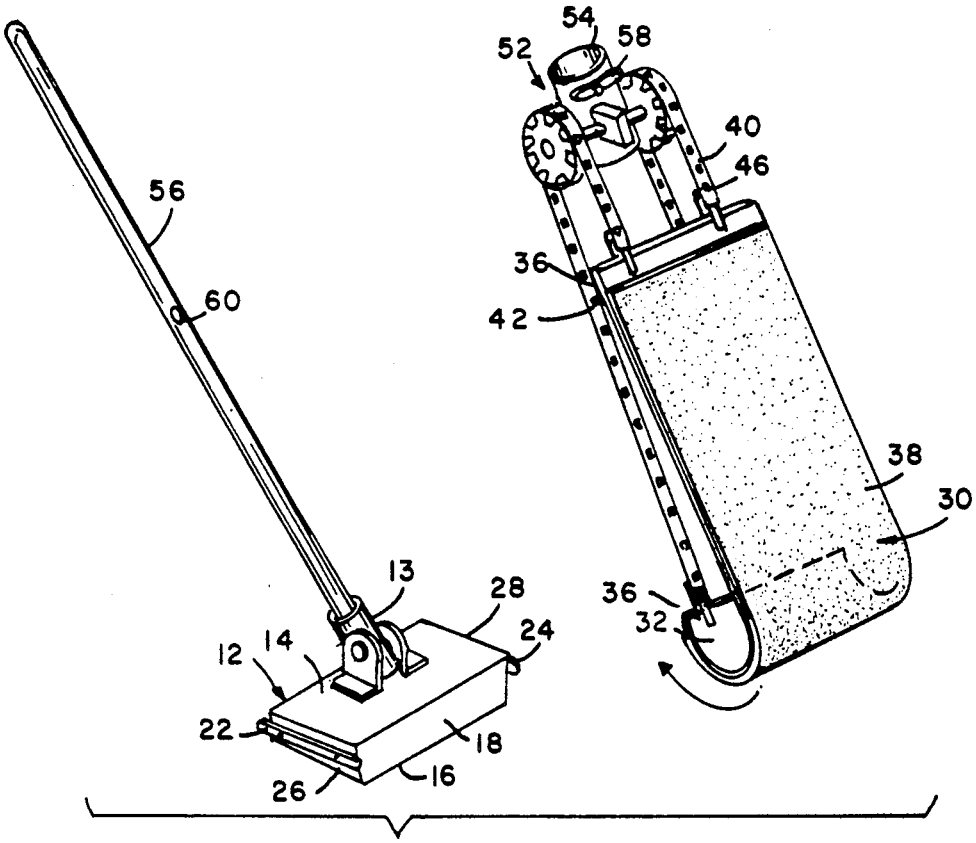
FIG. 1 is an exploded perspective view of one embodiment of a cleaning device embodying the principles of the present invention.

Referring now to the drawings and more particularly to FIGS. 1–5, there is illustrated generally by the numeral 10 a cleaning device embodying the principles of the present invention. As illustrated more particularly in FIGS. 1 and 2, the cleaning device 10 comprises a base member 12 which has a substantially planer top surface 14 and a bottom surface 16. In the preferred embodiment as shown, the top surface 14 is angular with respect to the horizontal bottom surface 16 whereby the front surface 18 is higher than the back surface 20. Also in the preferred embodiment, the base member 12 includes a pair of framework members 22 and 24 which are secured to the opposing sides 26 and 28 of the base member 12 and extend beyond the forward end surface 18 and the rearward end surface 20. As discussed herein, the framework members 22 and 24 serve to maintain the elongated flexible cleaning member 30 in position about the bottom surface 16 of the base member 12. It is also to be noted that the handle member 56 can be attached to the base member 12 by the pivotal device 13 whereby the handle is pivoted for free swinging movement forward and backward. Additionally, it is to be understood that the handle 56, base member 12 and framework members 22 and 24 can be formed, for example, of wood, metal, plastic and combinations thereof.

Figure 5:
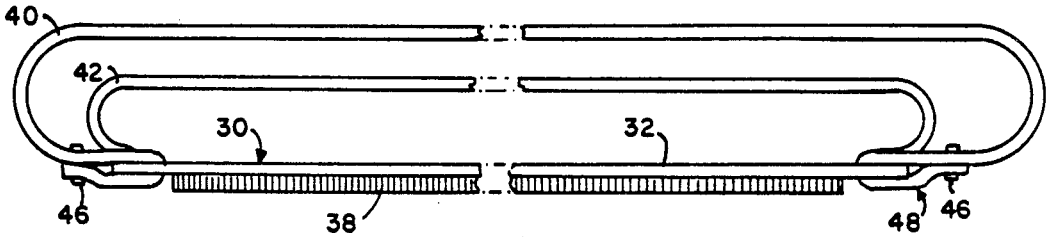
FIG. 5 is a fragmentary side elevational view of the flexible cleaning member with a pair of flexible cables attached to the ends of the cleaning member.
Figure 6:
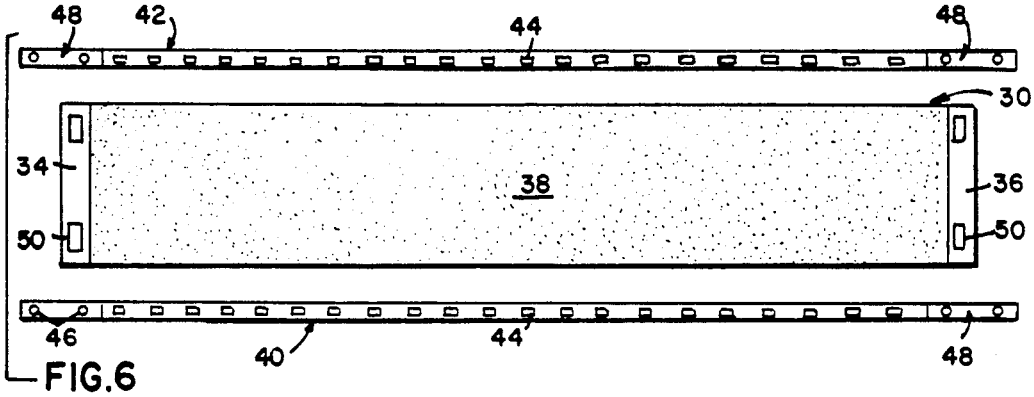
FIG. 6 is an exploded bottom plan view of the elongated flexible cleaning member and cables.

Referring now more particularly to FIGS. 5 and 6, the flexible cleaning member 30 has a substantially planer smooth inner surface 32 which terminates in opposing end sections 34 and 36. Mounted on the outer surface of the cleaning member 30 is a fabric cleaning material 38 such as a sponge fabric, cotton fabric, etc. depending upon the type of cleaning or polishing to be accomplished.

The cleaning member 30 includes a pair of flexible cable members 40 and 42. The cable members 40 and 42 are provided with spaced holes 44 defined by the cable members and with conventional snap buttons 46 attached to the end sections 48 of the cable member. The opposing end sections 48 are inserted through opposing end slots 50 and the snap buttons 46 attached to releasably secure the cable members 40 to the flexible cleaning member 30.

Figure 3:
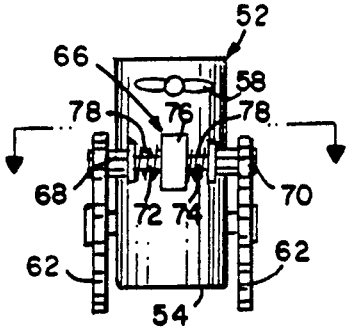
FIG. 3 is a top plan view of the clamp device for securing and operating the flexible cables which are attached to the flexible cleaning member.
Figure 4:
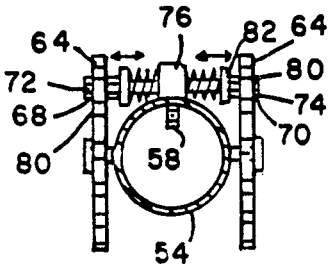
FIG. 4 is a cross-sectional view of the clamp device taken along the line 4—4 of FIG. 3.

As best seen in FIGS. 3 and 4 the cleaning device 10 includes a clamp means 52 which has a sleeve-like section 54 which can be attached to the handle member 56 by sliding it down about the handle so that the attaching means such as, for example, the screw member 58 which is on the top forward portion of the clamp means 52 can be put in threaded engagement with the threaded hole 60 in the handle member 56. The clamp means 52 also includes a pair of rotating disk members 62 which terminate circumferentially in finger-like members 64 which are adapted to engage the spaced holes 44 of the cable members 40 and 42 when attached to the clamp member 52. The clamp member 52 also includes a releasable locking means 66 which serves to hold the disk members 62 in the selected position. The locking means 66 comprises cylindrical bolt members 68 and 70 which slide concentrically back and forth about support members 72 and 74 which ar attached at the inner end to base member 76 and which contain spring members 78. The spring members 78 maintain the bolt members 68 and 70 in the selected holes 80 of each disk member 62 whereby the disk members 62 are prevented from rotating. When it is desired to rotate the disk members, the cylindrical members 68 and 70 are pushed inwardly by the rim members 82 to remove the cylindrical bolt members 68 and 70 out of the holes 80 of the disk members.

Figure 2:
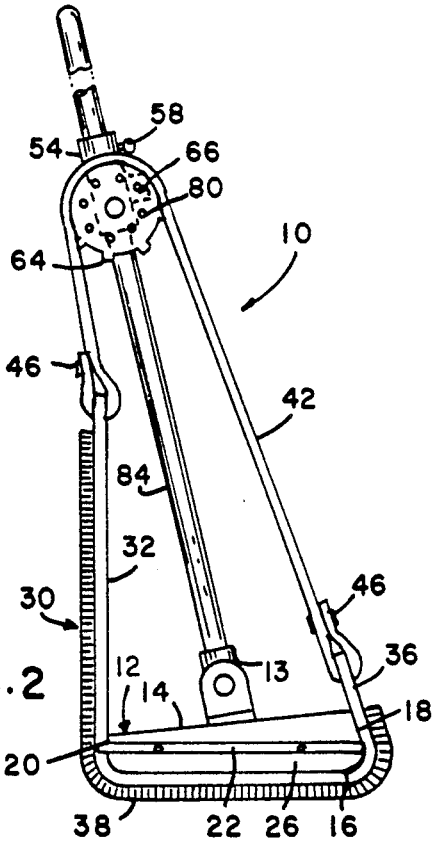
FIG. 2 is a fragmentary partially sectional side view of the assembled cleaning device of FIG. 1.

As best seen in FIG. 2, the cable members 40 and 42 are mounted on the respective disk members 62 so that the inner surface 32 of the cleaning member 30 is mounted about the bottom, front and rear surfaces 16, 18 and 20 of the base member 12 so that one end 36 of the cleaning member 30 is adjacent the forward surface 18 of the base member 12 and the other end 34 is adjacent the rearward portion 84 of the handle member 56 and the clamp member 52. In this manner the clamp member 52 provides for releasable movement of the cleaning member 30 about the lower surface 16 of the base member 12 to thereby remove the portion of the outer surface 38 of the cleaning member 30 which is dirty from cleaning about the lower surface of the base member 12 and introduce a clean section of the cleaning member 30 about the bottom portion 16 of the base member 12.

It is to be understood that when the cable members are formed of materials such as ropes as discussed hereinafter, the clamp member can be in the form of an arch-like configuration without the notch members 106 to thereby clamp the rope members in a selected position.

Figure 7:
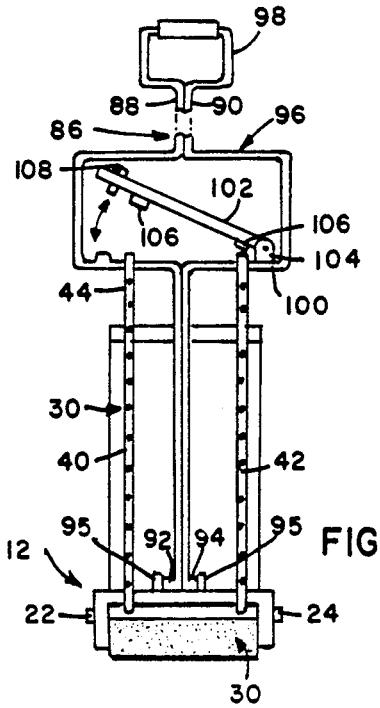
FIG. 7 is a front view of an alternate embodiment of a cleaning device embodying the principles of the present invention.

Referring now to FIG. 7, there is illustrated an alternate embodiment of the cleaning device of the present invention. In this embodiment, the base member 12, flexible cleaning member 30 and cable members 40 and 42 are similar to those of FIGS. 1-7. The handle member 86 is formed of two metal members 88 and 90 having end portions 92 and 94 which are pivotally attached to pivotal members 95 attached to the top surface of the base member 12. The metal members 88 and 90 extend upwardly and form a rectangular configuration portion 96 over which the cable members 40 and 42 travel and continue further to form the handle portion 98. The bottom portion 100 of the rectangular section 96 is provided with a clamping bar member 102. The clamping bar member 102 is hingedly connected to one end of the bottom section 100 as indicated at 104. The clamp bar member 102 is provided with notch members 106 which are arranged to insert into the holes 44 of the cable members 40 and 42 and secure them in a selected position until the operator wishes to advance the cleaning member so as to provide a clean section under the base member 12. The clamp bar member 102 is provided with a releasable attaching means such as, for example, screw member 108 which attaches to a threaded hole, not shown, in the section 100. When it is desired to move the cables 40 and 42 and the cleaning member 30 the clamp bar member 102 is manually released from the clamp position shown by the arrow and lifted and the movement applied.

The flexible cable members 40 and 42 can be formed of materials such as, for example, rope type material, plastic, leather, cloth and etc.

Figure 13:
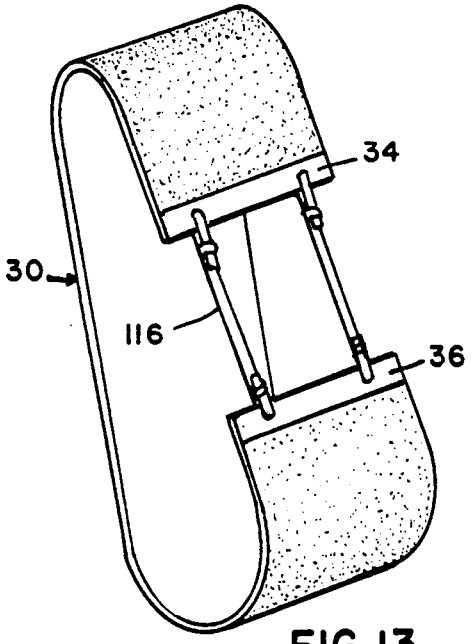
FIG. 13 is a perspective view of another form of the cable means for attaching the ends of the cleaning member.

Referring now to FIG. 13, there is illustrated an embodiment in which the end sections 34 and 36 of the flexible cleaning member 30 are attached together by rope members 116 which are inserted through the slots of the end members 34 and 36 and sealed or tied in position.

The inner surface 32 of the cleaning member 30 can be made of various flexible materials such as, for example, fabrics, plastic, leather, cloth and etc. with the selection being made to comply with the outer surface of the cleaning material 38 and the attachment thereof to the inner surface 32.

It should be understood (reference being made to FIGS. 1 and 2) that while the cables 40, 42 and the cleaning member 30 can be moved in a forward or rearward direction, the forward direction provides an advantage with respect to certain cleaning in that the dirty section when moved forward and angularly upward as shown in FIG. 1 the loss of dirt material is substantially reduced since the fabric cleaning surface 38 is not in an inverted position.

Figure 8:
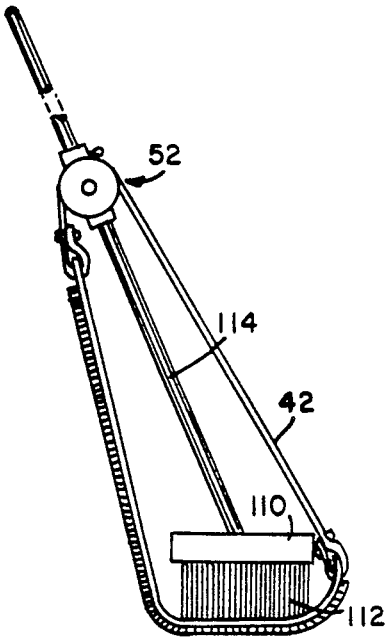
FIG. 8 is a fragmentary side elevational view of a cleaning device that embodies the principles of the present invention.

Referring now to FIG. 8, there is illustrated another important feature of the present invention. In this embodiment, the cleaning device comprises the clamp member 52, the flexible cable members 40 and 42 and the elongated flexible cleaning member 30 which as a unit cleaning device is adaptable to be mounted on an existing cleaning device such as a broom as shown having a base member 110 to which is attached a plurality of fibers 112 and a handle member 114. It is to be understood that this unit cleaning device embodiment of the present invention provides an important feature whereby the cleaning device can be mounted upon and operated with existing cleaning devices such as sponge mops, brooms and other such devices.

Figure 9:
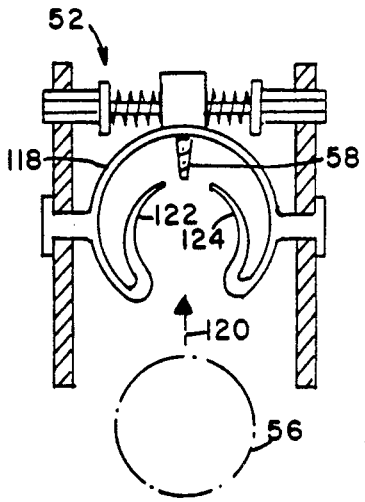
FIGS. 9 and 10 are cross-sectional views of alternate embodiments of the clamp device in accordance with the present invention.
Figure 10:
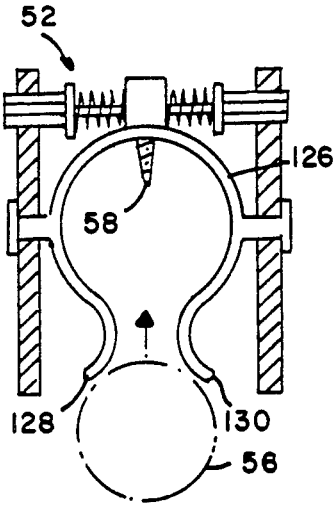

Referring now to FIGS. 9 and 10, there are shown alternate embodiments of the clamp device 52 illustrated in FIGS. 3 and 4. In FIGS. 9 and 10 the clamp device 52 is the same in all respects as the clamp device of FIGS. 2 and 3 except for the sleeve attachment member 54.

As illustrated in FIG. 9 the sleeve clip member 118 is opened at the bottom which opening 120 is defined by flexible end members 122 and 124 which extends upwardly into the circular member and toward the center to form an angular configuration suitable so that when the circular member 118 and the handle member 56 are pressed together as shown by the arrow 120 the end members 122 and 124 flexibly expand to receive the handle 56 and clamp it in place. The screw member 58 can be used to further secure the clamp device 52 in the selected position on a handle.

As illustrated in FIG. 10, the circular sleeve clip member 126 is similar to the sleeve clip member 118 except the end members 128 and 130 extend downwardly and outwardly to form an angular configuration suitable for clamping and holding the clamp member on a handle member.

Figure 11:
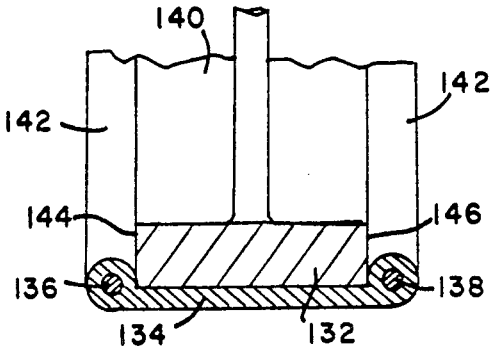
FIG. 11 is a fragmentary partially cross-sectional view of alternate embodiments of the base member and flexible cleaning member forming part of the cleaning device in accordance with the present invention.

FIG. 11 illustrates an alternative construction of the base member 132 which is not provided with framework such as 22 and 24 illustrated in FIGS. 1 and 2. In this embodiment the flexible cleaning member 134 includes flexible cable members 136 and 138 which are attached to each end of the inner surface 140 of the cleaning member 134 by cover sections 142. The cable member in this form contact the sides 144 and 146 of the base member 132 and prevent the cleaning member 134 from sliding off the base member 132.

Figure 12:
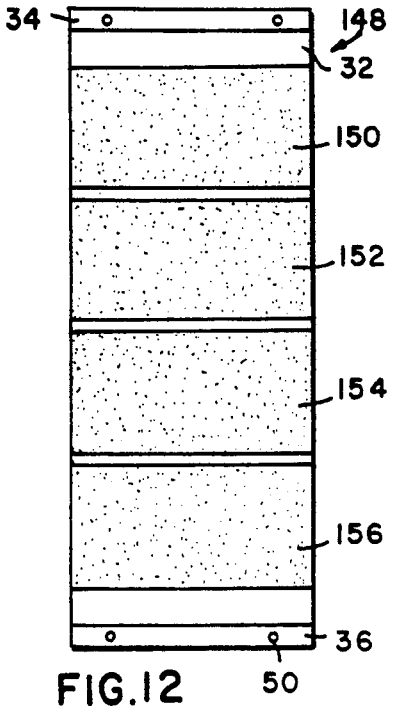
FIG. 12 is a bottom plan view of an alternate embodiment of the flexible cleaning member.

FIG. 12 illustrates an alternative form of a flexible cleaning member 148 having a plurality of different outer cleaning surfaces such as, for example, a flat wet mop material section 150, a flat dry mop material section 152, a short bristle material section 154, and a duster material section 156. It is to be understood that other sections of cleaning and polishing materials can be employed in accordance with the present invention.

Figure 14B:
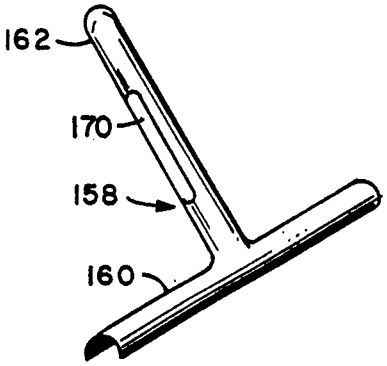
Figure 14A:
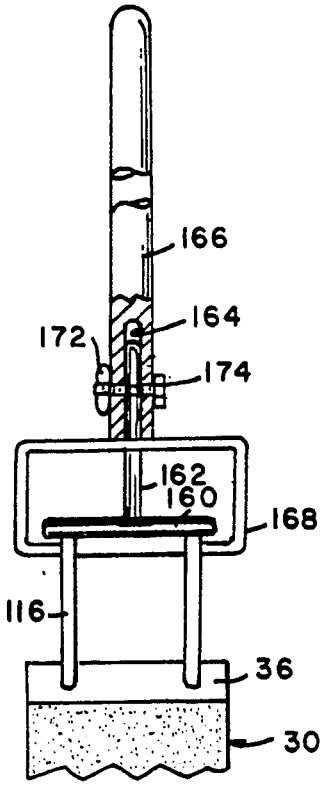
FIG. 14*a* is a fragmentary front view of another embodiment of the clamp device of the present invention.

FIGS. 14*a* and 14*b* illustrate an alternate embodiment of a clamping member 158 which consists of a arch shaped horizontal section 160 and a vertical section 162 which fits and slides within the opening 164 defined by the handle 166 which includes a rectangular member 168 through which the rope members 166, for example, pass. The vertical section 162 of the clamp member 158 is provided with an elongated opening 170 through which the bolt member 172 is inserted and attached to the nut member 174. In this manner when the bolt 172 is loosened the clamp member 158 can be raised and the rope member moved to move the cleaning member 30 to the selected position after which the clamp member is brought into contact with the rope member 116 and the bolt 172 tightened to hold the cleaning member 30 in the selected position.

Figure 15:
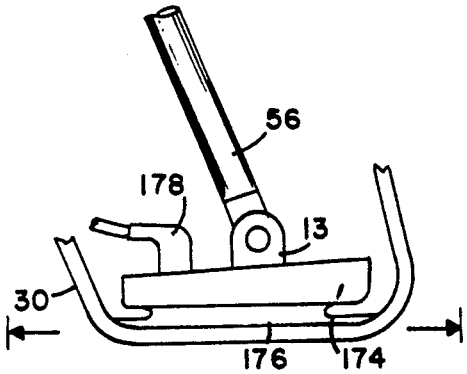
* and FIG. 15 is a fragmentary side elevational view of an alternate embodiment of the base member of the cleaning device.

Referring now to FIG. 15, there is illustrated an alternate embodiment of the base member of the cleaning device 10. As shown, the base member comprises a top portion 174 which engages a lower depending bed member 176 and including a connector 178 which may be a compress air connector or electrical connector for driving the depending bed member back and forth longitudinally as indicated by the arrows so that the portion of flexible cleaning member 30 covering the bottom of the base member is driven back and forth over the surface to be cleaned.

It is to be understood that while the present invention has been described with respect to certain embodiments, other variations are possible within the scope of the invention. For example other releasable locking means such as conventional ratchet means (not shown) can be used in place of the locking means 66 so that pivotal movement of the disk members 62 in one direction serves to rotate the disk members and hence the flexible cleaning member in the one preferred direction as indicated. In another example, the opposing end sections 48 of the cable members 40 and 42 (as best seen in FIGS. 5 and 6) can be provided with opposite types of VELCRO material (not shown) so that the gripping effect is achieved in place of the snap buttons 46.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A cleaning device adapted to be attached to an existing cleaning apparatus having a base member and an upwardly extending handle member, said cleaning device comprising:

an elongated flexible cleaning member having remote opposing end members, opposing side members and inner and outer surfaces;

said cleaning member having a cleaning material mounted on the outer surface to contact the surface area to be cleaned;

a pair of flexible mounting cable means each opposed ends attached to the respective opposed remote ends of said cleaning member;

a clamp means adapted for mounting on the handle member of the cleaning apparatus for engaging and removably securing said pair of flexible mounting cable means in selected positions;

said pair of flexible cable means releasably attached to said clamp means whereby said cleaning member is secured about the bottom surface of the base member;

said clamp means being releasable with respect to said mounting cable means whereby said mounting cable means are moveable to permit the section of said cleaning member positioned about the base member portion to be moved to thereby remove the section of said cleaning member which is dirty from cleaning from the bottom surface of said base member and introduce a clean section of said cleaning member about the bottom surface of the base member.

2. The cleaning device according to claim 2 wherein the clamp means includes a pair of rotary members for receiving the pair of flexible mounting cable means whereby rotation of said rotary members moves the cleaning member to a selected position about the bottom surface of the base member.

3. The cleaning device according to claim 1 wherein the clamp means includes a pair of rotary members for receiving said pair of flexible mounting cable means whereby said rotary members can be rotated to selected positions by manually rotating the rotary members.

4. The cleaning device according to claim 1 wherein the outer surface of the cleaning member is formed with different cleaning material sections.

5. The cleaning device according to claim 1 wherein the clamp means includes a clamp bar member which can be manually lowered to clamp said flexible mounting means in a selected position to thereby maintain the cleaning member in a selected position, and which can be manually raised to release said flexible mounting means to thereby enable the cleaning member to be manually moved to another selected position.

6. The cleaning device according to claim 1 wherein the clamp means comprises a clip member having a lower flexible opening section.

7. A cleaning device adapted to clean generally flat surfaces, said device comprising:

an elongated base member having a top surface and a bottom surface;

a handle member extending upwardly from the center of the top surface of said base member;

an elongated flexible cleaning member having remote opposing end members, opposing side members and inner and outer surfaces;

said cleaning member having a cleaning material mounted on the outer surface;

a pair of parallel flexible mounting means each with opposite ends attached between and to the respective opposed remote ends of said cleaning member;

a clamp means mounted on said handle member remote from said base member for engaging and securing said mounting means in selected positions;

said mounting means being releasably attachable to said clamp means to thereby mount and maintain the inner surface of said cleaning member about the bottom surface of said base member;

said clamp means being releasable with respect to said mounting means whereby the mounting means can be rotated to thereby permit the section of said cleaning member about said base portion to be moved to thereby remove the section of said cleaning member which is dirty from cleaning from the bottom surface of said base member and thereby introduce a clean section of said cleaning member about the bottom surface of the base member.

8. The cleaning device according to claim 7 wherein said clamp means includes a clamp bar which can be manually lowered to retain said pair of flexible mounting means in a selected position and which can be manually raised to permit said mounting means to be moved to another position.

9. The cleaning device according to claim 7 including a vibrating base member comprising a top member which engages a lower depending bed member, and connector means associated with the top member for drawing the depending lower bed member back and forth whereby the portion of the cleaning member covering the bottom surface of the base member is vibrated back and forth over the surface to be cleaned.

10. The cleaning device according to claim 7 wherein the clamp means includes a pair of disk members rotatably mounted on said clamp means and positioned on opposite sides of the clamp means, said disk members being adapted to receive the flexible mounting means, said disk members being adapted to rotate said mounting means to thereby move the cleaning member about the bottom portion of the base member.

11. The cleaning device according to claim 10 including locking means to releasably lock the disk members in a selected fixed position.

12. A cleaning device adapted to clean generally flat surfaces, said device comprising:

an elongated base member having a substantially planer top surface and an angular bottom surface;

a handle member extending upwardly from the center of the top surface of said base member and having a forward portion and a rearward portion;

a pair of framework members adapted to be secured to the opposing side ends of said base member and extending beyond the forward and rearward side ends of said base member;

an elongated flexible cleaning member having remote opposing end members, opposing side members and inner and outer surfaces;

said cleaning member having cleaning material mounted on the outer surface;

clamp means mounted on said handle member;

mounting means having opposed ends attached between and to the respective opposed remote ends of said cleaning member;

said mounting means being releasably attached to said clamp means to thereby mount the inner surface of said cleaning member about the bottom surface of said base member and within the frame work members and retaining one end of said cleaning member adjacent the clamping means and the other end of said cleaning member adjacent the forward portion of the top surface of said base member thereby retaining the cleaning member along the rearward portion of the handle member and about the lower surface of the base member;

said clamp means being releasable with respect to said mounting means to permit manual rotation of the mounting means whereby the section of said cleaning member about said base portion is moved upwardly along the forward portion of said handle member to thereby remove the portion of said cleaning member which is dirty from cleaning and introducing a clean section of said cleaning member about the bottom surface of the base member.

13. The cleaning device according to claim 12 wherein said clamp means includes a clamp bar which can be manually lowered to retain said pair of flexible mounting means in a selected position and which can be manually raised to permit said mounting means to be moved to another position.

14. The cleaning device according to claim 12 including a vibrating base member comprising a top member which engages a lower depending bed member, and connector means associated with the top member for drawing the depending lower bed member back and forth whereby the portion of the cleaning member covering the bottom surface of the base member is vibrated back and forth over the surface to be cleaned.

15. The cleaning device according to claim 12 wherein the clamp means includes a pair of disk members rotatably mounted on said clamp means and positioned on opposite sides of the clamp means, said disk members being adapted to receive the flexible mounting means, said disk members being adapted to rotate said mounting means to thereby move the cleaning member about the bottom portion of the base member.

16. The cleaning device according to claim 15 including locking means to releasably lock the disk members in a selected fixed position.

* * * * *